US010892580B2

(12) United States Patent
Kanamori et al.

(10) Patent No.: US 10,892,580 B2
(45) Date of Patent: Jan. 12, 2021

(54) ELECTRICAL CONNECTOR WITH REAR PRESSING PINS PRESSING ON A TERMINAL FITTING

(71) Applicant: Yazaki Corporation, Tokyo (JP)

(72) Inventors: Takanori Kanamori, Kakegawa (JP); Kohei Toyoshima, Kakegawa (JP); Kei Fujimoto, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/695,760

(22) Filed: Nov. 26, 2019

(65) Prior Publication Data

US 2020/0169026 A1 May 28, 2020

(30) Foreign Application Priority Data

Nov. 26, 2018 (JP) ..... 2018-220058

(51) Int. Cl.
*H01R 13/436* (2006.01)
*H01R 24/28* (2011.01)
(Continued)

(52) U.S. Cl.
CPC ..... *H01R 13/4367* (2013.01); *H01R 13/04* (2013.01); *H01R 24/28* (2013.01);
(Continued)

(58) Field of Classification Search
CPC ..... H01R 13/4367; H01R 13/04; H01R 2103/00; H01R 13/055; H01R 24/28; H01R 13/6395; H01R 13/113; H01R 13/193; H01R 13/642; H01R 12/58; H01R 13/20; H01R 24/86; H01R 13/08; H01R 13/114;
(Continued)

(56) References Cited

U.S. PATENT DOCUMENTS 4,556,264 A * 12/1985 Tanaka ..... H01R 13/4367 439/62
6,331,126 B1 * 12/2001 Wagner ..... H01R 13/6477 439/676
(Continued)

FOREIGN PATENT DOCUMENTS

JP 2012-069271 A 4/2012

*Primary Examiner* — Abdullah A Riyami
*Assistant Examiner* — Justin M Kratt
(74) *Attorney, Agent, or Firm* — Banner & Witcoff, Ltd.

(57) ABSTRACT

A connector is to be joined to a mating connector. The connector includes a terminal fitting including an electrical connection portion to be connected to a mating terminal of the mating connector, a housing including an insertion hole, the electrical connection portion inserted through the insertion hole and a rear holder attached to the housing such that the rear holder presses and holds the terminal fitting against the housing. The housing includes a reference surface to restrict the electrical connection portion, with a portion of the terminal fitting abutting the reference surface, from being further inserted into the insertion hole. The rear holder includes a pressing pin to press, when the rear holder is attached to the housing, the terminal fitting from a rear side of the terminal fitting such that the pressing pin is partially and plastically deformed and the terminal fitting is pressed against the reference surface.

6 Claims, 7 Drawing Sheets

(51) Int. Cl.

| | |
|---|---|
| ***H01R 13/04*** | (2006.01) |
| *H01R 103/00* | (2006.01) |
| *H01R 24/00* | (2011.01) |
| *H01R 13/08* | (2006.01) |
| *H01R 13/11* | (2006.01) |
| *H01R 13/10* | (2006.01) |
| *H01R 13/24* | (2006.01) |
| *H01R 33/76* | (2006.01) |
| *H01R 13/639* | (2006.01) |
| *H01R 12/58* | (2011.01) |
| *H01R 13/193* | (2006.01) |
| *H01R 13/20* | (2006.01) |
| *H01R 24/86* | (2011.01) |
| *H01R 24/66* | (2011.01) |
| *H01R 12/91* | (2011.01) |
| *H01R 9/24* | (2006.01) |
| *H01R 13/05* | (2006.01) |
| *H01R 13/631* | (2006.01) |
| *H01R 13/642* | (2006.01) |
| *H01R 33/975* | (2006.01) |
| *H01R 13/502* | (2006.01) |

(52) U.S. Cl.
CPC ..... *H01R 9/24* (2013.01); *H01R 9/2408* (2013.01); *H01R 12/58* (2013.01); *H01R 12/91* (2013.01); *H01R 13/055* (2013.01); *H01R 13/08* (2013.01); *H01R 13/10* (2013.01); *H01R 13/11* (2013.01); *H01R 13/113* (2013.01); *H01R 13/114* (2013.01); *H01R 13/193* (2013.01); *H01R 13/20* (2013.01); *H01R 13/24* (2013.01); *H01R 13/5025* (2013.01); *H01R 13/6315* (2013.01); *H01R 13/6395* (2013.01); *H01R 13/642* (2013.01); *H01R 24/00* (2013.01); *H01R 24/66* (2013.01); *H01R 24/86* (2013.01); *H01R 33/7664* (2013.01); *H01R 33/975* (2013.01); *H01R 2103/00* (2013.01)

(58) Field of Classification Search
CPC ..... H01R 24/00; H01R 24/66; H01R 9/24; H01R 9/2408; H01R 13/6315; H01R 33/975; H01R 12/91; H01R 13/24; H01R 33/7664; H01R 13/10; H01R 13/11; H01R 13/5025
USPC ..... 439/2, 382, 345
See application file for complete search history.

(56) References Cited

U.S. PATENT DOCUMENTS 6,851,984 B2 * 2/2005 Chang ..... H01R 13/5045 439/676
9,490,570 B1 * 11/2016 Hashiguchi ..... H01R 13/28

* cited by examiner

ELECTRICAL CONNECTOR WITH REAR PRESSING PINS PRESSING ON A TERMINAL FITTING

CROSS-REFERENCE TO RELATED APPLICATION

The present application claims priority to Japanese Patent Application No. 2018-220058 filed on Nov. 26, 2018, the entire content of which is incorporated herein by reference.

TECHNICAL FIELD

The present invention relates to a connector.

BACKGROUND

According to a related art connector, a terminal fitting having an electrical connection portion (connection portion) to be connected to a mating terminal is accommodated in a housing (a terminal cover) provided by combining a cover body and a lid (for example, JP2012-69271A).

In order to absorb positional deviation between the connector and the mating terminal, the terminal fitting is accommodated in the housing with play. However, due to the play, variation occurs in protruding length of the electrical connection portion of the terminal fitting, which is to be connected to the mating terminal, from the housing. In this case, if the terminal fitting is inserted or fitted to the housing in a pressed manner, thereby the terminal fitting being fixed to the housing, the protruding length of the electrical connection portion from the housing can be accurately controlled. However, since no play (e.g., space in which the terminal fitting can move) is provided in upper-lower and left-right directions orthogonal to the connecting direction of the terminal fitting to the housing, alignment of the terminal fitting with the mating terminal during connection is difficult.

SUMMARY

Illustrative aspects of the present invention provide a connector configured to accurately control a protruding length of a terminal fitting from a housing while absorbing positional deviation of the terminal fitting in a direction orthogonal to a connecting direction with a mating terminal.

According to an illustrative aspect of the present invention, a connector is configured to be joined to a mating connector, the connector including a terminal fitting including an electrical connection portion configured to be connected to a mating terminal of the mating connector, a housing including an insertion hole extending in a direction in which the electrical connection portion is connected to the mating terminal, the electrical connection portion being inserted through the insertion hole from a rear side of the housing and protruding from a front side of the housing; and a rear holder attached to the rear side of the housing such that the rear holder presses and holds the terminal fitting against the housing. The housing further includes a reference surface arranged to restrict the electrical connection portion, with a portion of the terminal fitting abutting the reference surface, from being further inserted into the insertion hole. The rear holder includes a pressing pin configured to press, when the rear holder is attached to the housing, the terminal fitting from a rear side of the terminal fitting such that the pressing pin is partially and plastically deformed and such that the terminal fitting is pressed against the reference surface.

Other aspects and advantages of the invention will be apparent from the following description, the drawings and the claims.

BRIEF DESCRIPTION OF THE DRAWINGS

FIGS. 3A and 3B are views showing the connector according to the present embodiment, in which FIG. 3A is a front view and FIG. 3B is a side view;

FIGS. 4A and 4B are views showing the connector according to the present embodiment, in which FIG. 4A is a cross-sectional view taken along a line A-A in FIG. 3A, and FIG. 4B is a cross-sectional view taken along a line B-B in FIG. 3A;

FIGS. 5A and 5B are views showing a rear holder, in which FIG. 5A is a front view of the rear holder, and FIG. 5B is a cross-sectional view taken along a line D-D in FIG. 5A;

FIGS. 6A and 6B are views showing a state of a pressing pin when the rear holder is attached to a housing, in which FIG. 6A is a cross-sectional view taken along a line C-C in FIG. 3A before assembly is completed, and FIG. 6B is a cross-sectional view taken along the line C-C in FIG. 3A after the assembly is completed.

DESCRIPTION OF EMBODIMENTS

Figure 1:
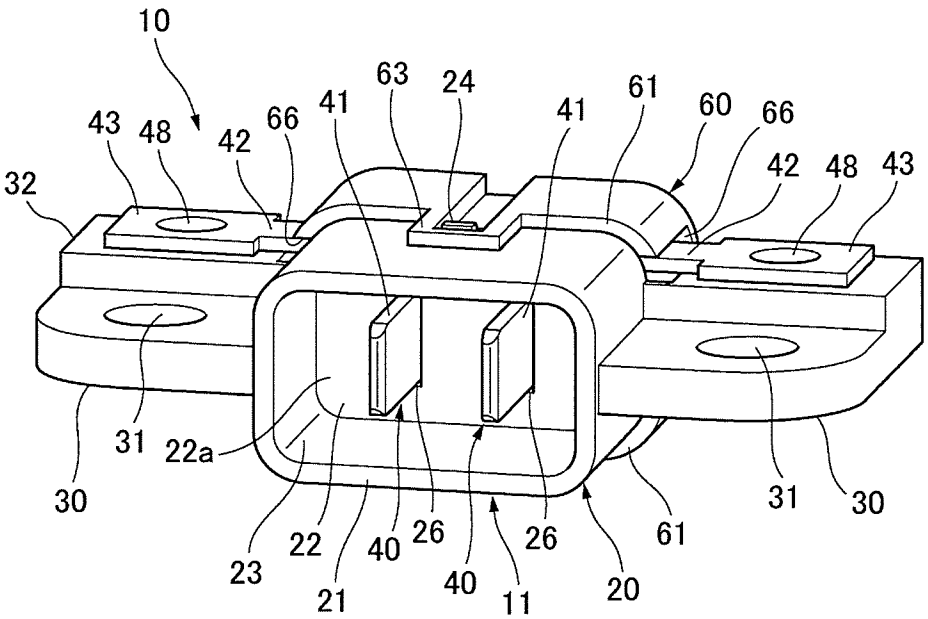
FIG. 1 is a perspective view of a connector according to the present embodiment.
Figure 2:
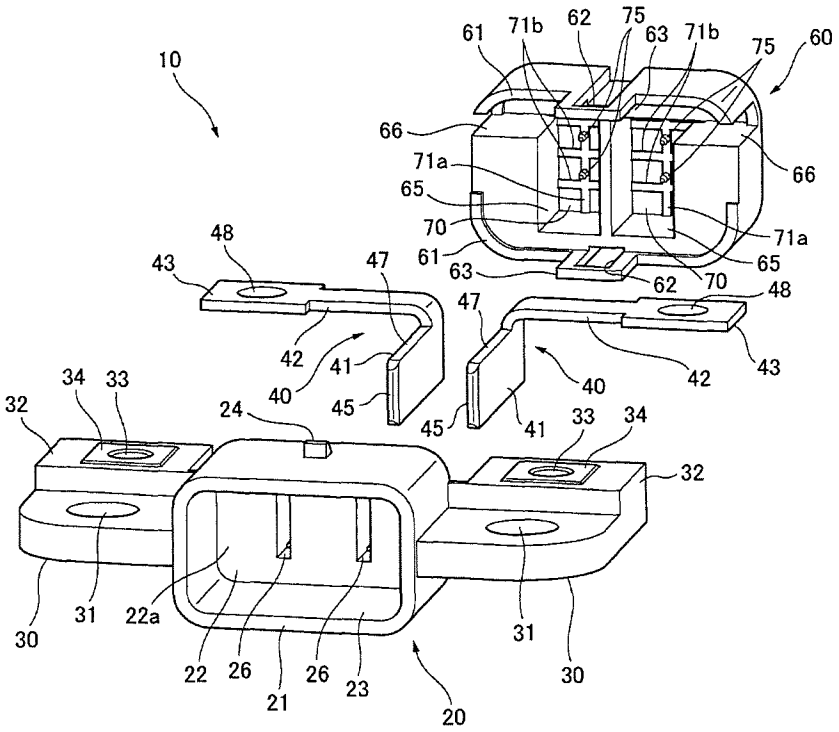
FIG. 2 is an exploded perspective view of the connector according to the present embodiment.
Figure 3B:
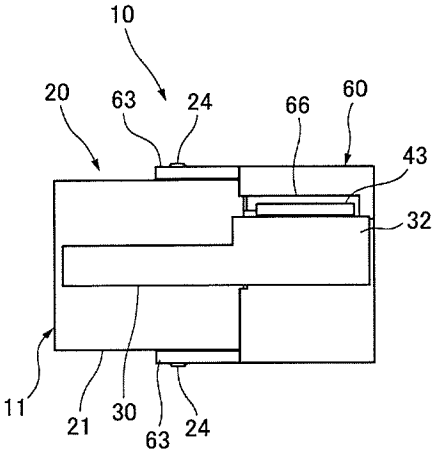
Figure 3A:
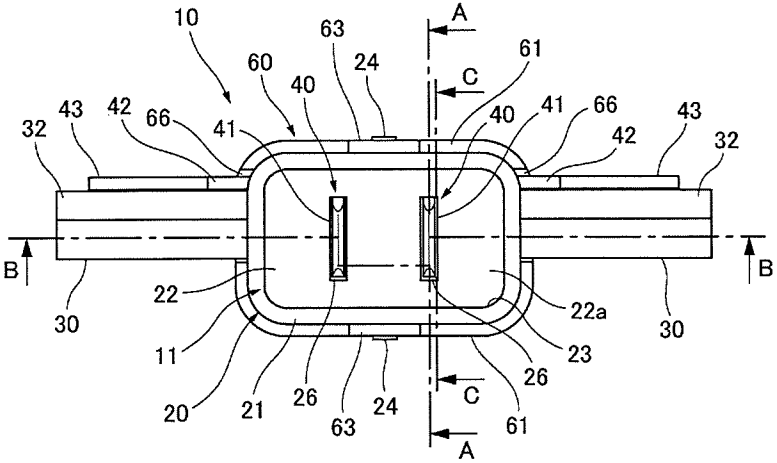
Figure 4A:
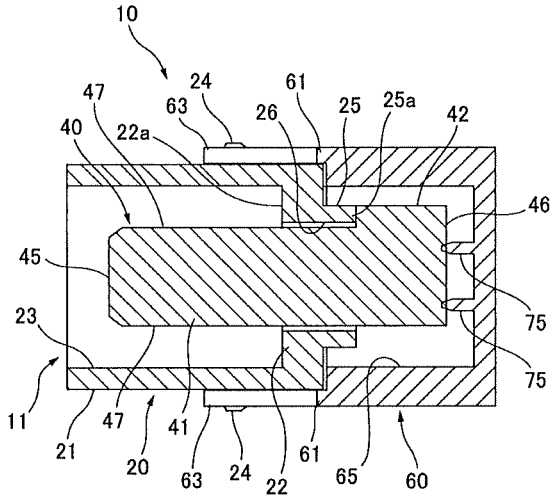
Figure 4B:
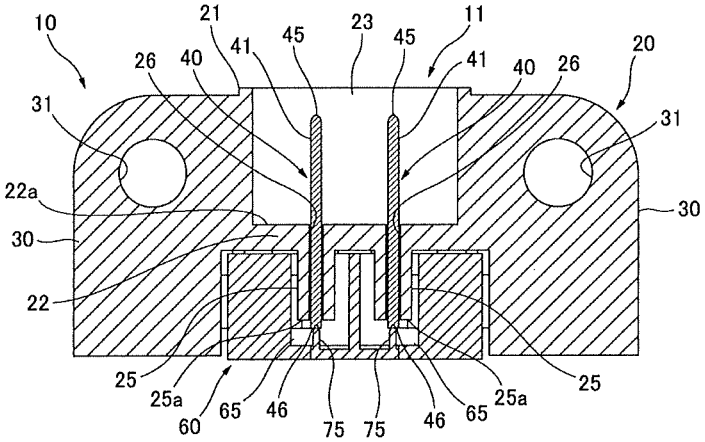

Hereinafter, exemplary embodiments of the present invention will be described in detail with reference to the drawings. FIG. 1 is a perspective view of a connector according to the present embodiment. FIG. 2 is an exploded perspective view of the connector according to the present embodiment. FIGS. 3A and 3B are views showing the connector according to the present embodiment, in which FIG. 3A is a front view and FIG. 3B is a side view. FIGS. 4A and 4B are views showing the connector according to the present embodiment, in which FIG. 4A is a cross-sectional view taken along a line A-A in FIG. 3A, and FIG. 4B is a cross-sectional view taken along a line B-B in FIG. 3A.

As shown in FIGS. 1 to 4, a connector 10 according to the present embodiment includes a housing 20, a pair of terminal fittings 40 and a rear holder 60. The terminal fittings 40 and the rear holder 60 are attached to the housing 20 in order from a rear side of the housing 20, the rear side being opposite to a joint portion 11 of the housing 20.

The connector 10 is to be joined to a mating connector (not shown), such that the terminal fittings 40 are to be connected to mating terminals (not shown) of the mating connector. A front side of the connector 10 is the joint portion 11 to be joined to the mating connector.

The housing 20 is integrally made of an insulating synthetic resin. The housing 20 is formed in a recessed shape with a joint portion 11 side opened. The housing 20 includes a peripheral wall 21 and a bottom wall 22. A fitting recess 23 is provided with the peripheral wall 21 and the bottom wall 22 with a front side facing the mating connector being opened.

The peripheral wall 21 is formed in a rectangular tube shape, and locking claws 24 protrude outward from an outer surface of the peripheral wall 21 at upper and lower portions of the peripheral wall 21. The locking claws 24 are provided at a central position in a width direction of the housing 20.

The bottom wall 22 is integrally provided on a rear side of the peripheral wall 21. The bottom wall 22 includes two protruding portions 25 protruding rearward from a rear surface of the bottom wall 22 (see FIGS. 4A and 4B). In addition, insertion holes 26 provided as a pair of square holes run through the bottom wall 22 in a front-rear direction of the housing 20. The each of the insertion holes 26 is provided at intervals at positions where the protruding portions 25 are provided. The insertion holes 26 are opened at a front surface 22*a* of the bottom wall 22 and end surfaces 25*a* of the protruding portions 25.

In the housing 20, fixing plate portions 30 are provided on both side portions of the peripheral wall 21. The fixing plate portion 30 is provided integrally with the peripheral wall 21, and is provided in a plate shape extending along the front-rear direction of the housing 20. Each fixing plate portion 30 has a fixing hole 31. A bolt (not shown) is to be inserted into the fixing hole 31 of the fixing plate portion 30. Then, the bolt inserted into the fixing hole 31 is to be screwed into a screw portion such as an electrical connection box, such that the connector 10 is to be fixed to the electrical connection box.

The fixing plate portion 30 includes a terminal fixing portion 32 at a rear portion of the fixing plate portion 30, the terminal fixing portion 32 having a larger thickness than the fixing plate portion 30. A nut 34 having a female screw 33 is embedded in the terminal fixing portion 32. The nut 34 is exposed on an upper surface side of the terminal fixing portion 32.

The terminal fitting 40 is provided as a plate made of a conductive metal such as copper and aluminum. The terminal fitting 40 is formed by pressing. The terminal fitting 40 includes an electrical connection portion 41, a connection portion 42 and a fixing portion 43. The electrical connection portion 41 is formed in a rectangular flat plate shape, and includes a tip end surface 45, a rear end surface 46 and side end surfaces 47. The electrical connection portion 41 is attached to the housing 20, such that an extending direction of the electrical connection portion 41 is aligned with a connecting direction with the mating terminal of the mating connector.

One end side of the connection portion 42 is connected to a rear side of one side end surface 47 of the electrical connection portion 41. The connection portion 42 is formed in a band shape, and bends and extends toward a lateral side substantially orthogonal to the extending direction of the electrical connection portion 41. In the terminal fittings 40, each of the connection portions 42 extends in opposite directions with each other. The fixing portion 43 is connected to the other end side of the connection portion 42. The fixing portion 43 is formed in a plate shape having a hole 48, and extends along an extending direction of the connection portion 42. The terminal fitting 40 is attached to the housing 20 by inserting the electrical connection portion 41 into the insertion hole 26 of the housing 20 from the rear side. The insertion hole 26 of the housing 20 through which the electrical connection portion 41 is inserted is provided as a slightly larger hole than an outer shape of the electrical connection portion 41 in a cross-sectional view.

The electrical connection portion 41 of the terminal fitting 40 inserted into the insertion hole 26 protrudes from the front surface 22*a* of the bottom wall 22 of the housing 20 and is disposed in the fitting recess 23. Then, the terminal fitting 40 whose electrical connection portion 41 is inserted into the insertion hole 26 abuts the end face 25*a* of the protruding portion 25 of the housing 20 at the connection portion 42. The end surface 25*a* of the protruding portion 25 on which the connection portion 42 of the terminal fitting 40 abuts is a reference surface for managing protruding length, in other words a protruding dimension of the electrical connection portion 41 from the front surface 22*a* of the bottom wall 22. The connection portion 42 abuts the end surface 25*a* of the protruding portion 25 serving as the reference surface, such that movement of the electrical connection portion 41 in a direction in which the electrical connection portion 41 is inserted into the insertion hole 26 is restricted.

By attaching the terminal fitting 40 to the housing 20, the fixing portion 43 of the terminal fitting 40 is overlapped with the nut 34 of the terminal fixing portion 32 provided on the fixing plate portion 30 of the housing 20. Accordingly, the hole 48 provided in the fixing portion 43 is screwed with the female screw 33 of the nut 34. To the fixing portion 43, for example, a connection terminal (not shown) provided at an end of an electric wire can be connected. Specifically, the connection terminal is overlapped with the fixing portion 43 such that a hole of the connection terminal communicates with the hole 48 screwed with the female screw 33, and the bolt (not shown) is inserted. The bolt is screwed into the female screw 33 of the nut 34 and fastened. Accordingly, the fixing portion 43 of the terminal fitting 40 and the connection terminal of the electric wire are fastened together by the bolt, and the terminal fitting 40 and the electric wire are electrically connected.

The rear holder 60 is integrally made of an insulating synthetic resin. The rear holder 60 includes engagement walls 61 on a front side, which is an assembling side to the housing 20. The engagement walls 61 are provided on upper and lower sides of the rear holder 60. A locking portion 63 having a locking window 62 is provided in each engagement wall 61. The locking portion 63 is provided at a central position in a width direction of the rear holder 60.

The rear holder 60 has two accommodation recesses 65 that are opened at the attaching side to the housing 20. Each of the protruding portion 25 of the housing 20 into which the electrical connection portion 41 of the terminal fitting 40 is inserted is accommodated in each accommodation recess 65. In the rear holder 60, a notch 66 communicating with the accommodation recess 65 is provided on the attaching side to the housing 20. The connection portion 42 of the terminal fitting 40 is accommodated in the notch 66.

Figure 5B:
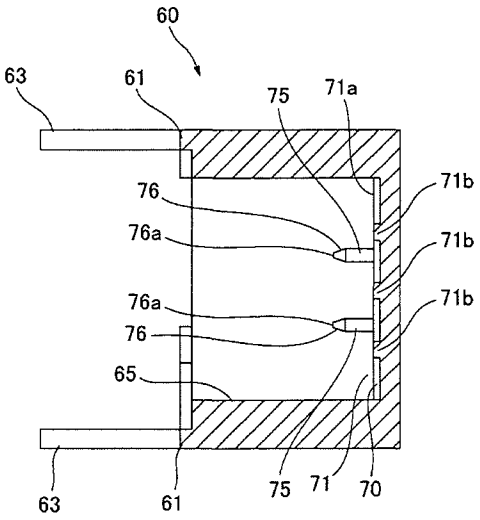
Figure 5A:
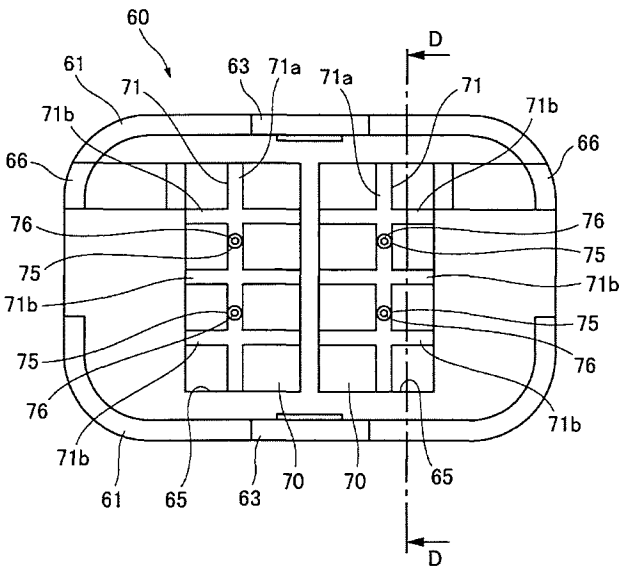

FIGS. 5A and 5B are views showing a rear holder, in which FIG. 5A is a front view of the rear holder, and FIG. 5B is a cross-sectional view taken along a line D-D in FIG. 5A. As shown in FIGS. 5A and 5B, a grid rib 71 is provided on a bottom surface 70 of the accommodation recess 65. The grid rib 71 is provided by a plurality of linear vertical ribs 71*a* and horizontal ribs 71*b* arranged at intervals, and the vertical ribs 71*a* and the horizontal ribs 71*b* are provided in a grid pattern so as to be orthogonal to each other.

In the bottom surface 70 of each accommodation recess 65, two pressing pins 75 protruding in the attaching direction to the housing 20 are provided on the grid rib 71. The pressing pins 75 protrude from the vertical ribs 71*a* of the grid rib 71, and are arranged at intervals in an upper-lower direction. The pressing pins 75 are provided at positions facing the rear end surface 46 of the electrical connection portion 41 of the terminal fitting 40 accommodated in the accommodation recess 65.

Tip ends of the pressing pins 75 are provided as crushable distal end portions 76. The crushable distal end portion 76 is provided in a tapered shape whose cross-sectional area gradually decreases toward the tip end. Specifically, the crushable distal end portion 76 is provided in a conical shape. The crushable distal end portion 76 may have a pyramidal shape. The crushable distal end portion 76 has a flat distal end 76*a* orthogonal to a direction in which the rear holder 60 is attached to the housing 20.

In the connector 10 having the above structure, the joint portion 11 is to be joined to the mating connector. Specifically, a housing of the mating connector is to be fitted into the fitting recess 23 provided in the housing 20 of the connector 10. Accordingly, the electrical connection portion 41 of the terminal fitting 40 protruding into the fitting recess 23 is to be inserted and to be electrically connected to the mating terminal serving as a female terminal of the mating connector.

Next, assembling of the connector 10 according to the present embodiment will be described. To attach the connector 10, first, the terminal fitting 40 is attached to the housing 20. Specifically, the electrical connection portion 41 of the terminal fitting 40 is inserted into the insertion hole 26 of the housing 20 from the rear side. Then, the electrical connection portion 41 of the terminal fitting 40 is disposed to protrude into the fitting recess 23 from the front surface 22*a* of the bottom wall 22 of the housing 20.

Next, the rear holder 60 is attached from the rear side of the housing 20 to which the terminal fitting 40 has been attached. Specifically, the rear holder 60 is brought close to the rear end of the housing 20, and the protruding portion 25 of the housing 20 is inserted into the accommodation recess 65 of the rear holder 60. Then, the rear holder 60 is pushed into the housing 20, and the rear end of the housing 20 is fitted between the upper and lower engagement walls 61 of the rear holder 60. Then, the locking claw 24 of the housing 20 enters the locking window 62 of the locking portion 63 of the rear holder 60, such that the locking claw 24 locks the locking portion 63. Accordingly, the rear holder 60 is attached to the housing 20 to which the terminal fitting 40 is attached.

Figure 6A:
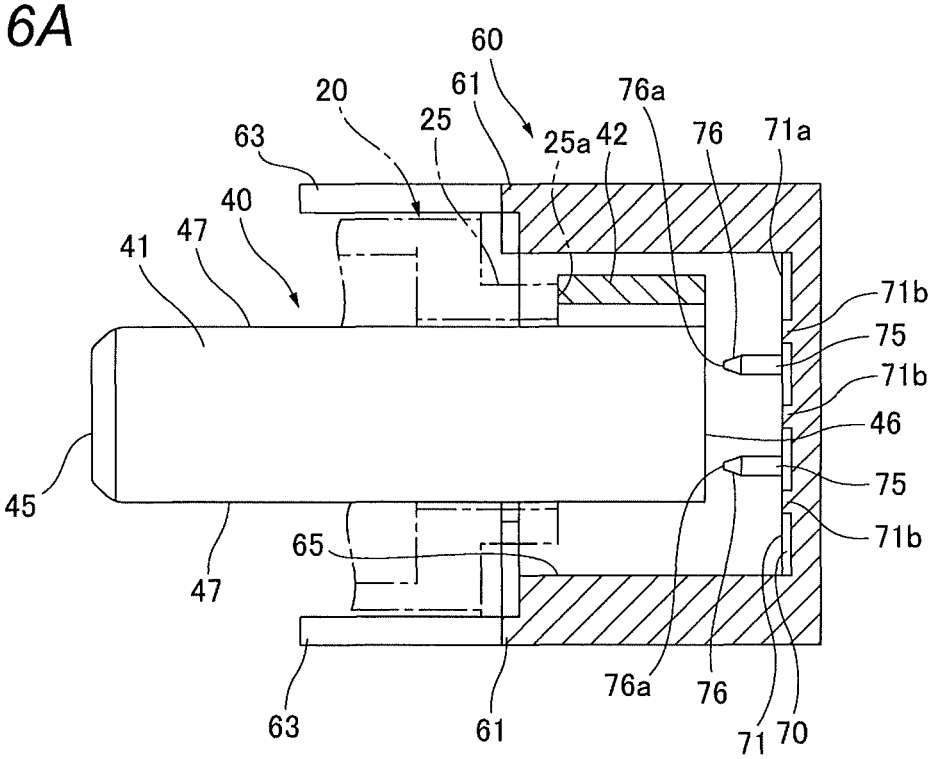
Figure 6B:
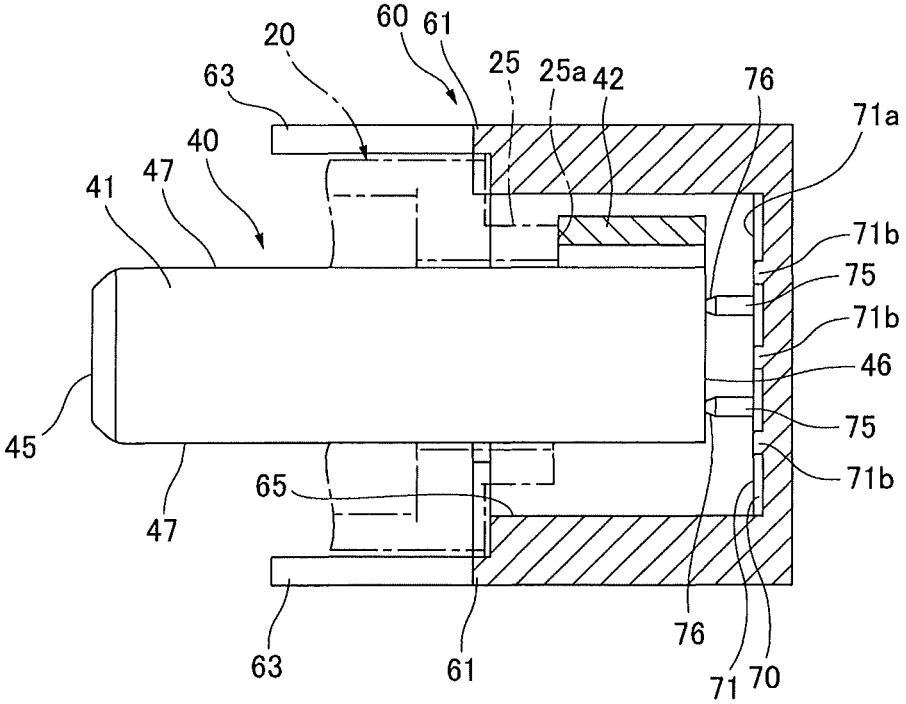

Next, the pressing pin 75 during assembling the connector 10 will be described. FIGS. 6A and 6B are views showing a state of a pressing pin when the rear holder is attached to a housing, in which FIG. 6A is a cross-sectional view taken along a line C-C in FIG. 3A before assembly is completed, and FIG. 6B is a cross-sectional view taken along the line C-C in FIG. 3A after the assembly is completed.

As shown in FIG. 6A, as the rear holder 60 is being attached to the housing 20 to which the terminal fitting 40 has been attached, the tip end of the pressing pin 75 of the rear holder 60 comes close to the rear end surface 46 of the electrical connection portion 41 of the terminal fitting 40. The flat distal end 76*a* of the crushable distal end portion 76 of the pressing pin 75 abuts the rear end surface 46 of the electrical connection portion 41.

As shown in FIG. 6B, when the rear holder 60 is further pushed into the housing 20, and when the locking claw 24 locks the locking portion 63 completely, the crushable distal end portion 76 at the tip end of the pressing pin 75 is pressed against the rear end surface 46 of the electrical connection portion 41 of the terminal fitting 40 and plastically deformed into a crushed state. Thereby, the electrical connection portion 41 is supported in a state where the connection portion 42 is pressed against the reference surface provided as the end surface 25*a* of the protruding portion 25 of the housing 20. Accordingly, in the housing 20, the electrical connection portion 41 protrudes into the fitting recess 23 with a predetermined protrusion dimension, and is supported in a state where movement in the front-rear direction, which is the protruding direction, is restricted. The insertion hole 26 of the housing 20 through which the electrical connection portion 41 of the terminal fitting 40 is inserted is provided as a hole slightly larger than the outer shape of the electrical connection portion 41 in the cross-sectional view. Therefore, the electrical connection portion 41 inserted into the insertion hole 26 is slightly movable in upper-lower and left-right directions orthogonal to a connecting direction with the mating terminal, which is the inserting direction into the insertion hole 26.

As described above, according to the connector 10 according to the present embodiment, when the rear holder 60 is attached to the housing 20, the pressing pin 75 presses the electrical connection portion 41 of the terminal fitting 40 from the rear side, and the crushable distal end portion 76 at the tip end is plastically deformed. Accordingly, the connection portion 42, a part of the terminal fitting 40, is pressed against the end surface 25*a* of the protruding portion 25 serving as the reference surface of the housing 20, and is held such that the terminal fitting 40 does not rattle in the connecting direction with the mating terminal. Therefore, the protruding length, in other words the protruding dimension of the electrical connection portion 41 from an front end of the insertion hole 26, can be accurately controlled compared to a structure in which the electrical connection portion 41 of the terminal fitting 40 is inserted in a pressed-manner and fixed to the housing 20, since play can be provided in the upper-lower and left-right directions orthogonal to the connecting direction with the mating terminal. Accordingly, positional deviation with the mating terminal during joining with the mating connector can be absorbed, and the joining with the mating connector can be smoothly performed.

Since the rear end surface 46 of the flat plate shaped electrical connection portion 41 is pressed by the pressing pin 75, the electrical connection portion 41 is pressed straight toward the connecting direction with the mating terminal of the mating connector. Accordingly, the electrical connection portion 41 can protrude from the front end of the insertion hole 26 without inclination.

In addition, since the pressing pin 75 is provided in the grid rib 71 provided on the bottom surface 70 of the rear holder 60, rigidity of the pressing pin 75 can be increased, and the electrical connection portion 41 of the terminal fitting 40 can be pressed more firmly against the end face 25*a* of the protruding portion 25 serving as the reference surface, thereby controlling the protruding length of the electrical connection portion 41 accurately.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

Figure 7:
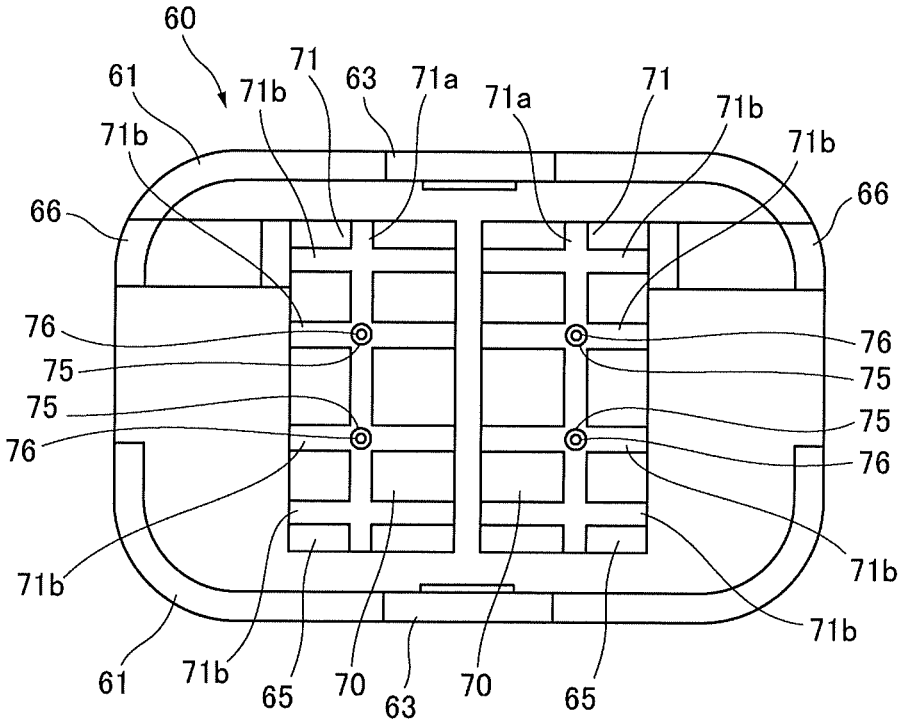
FIG. 7 is a front view of a rear holder having another shape.

For example, in the above embodiment, the pressing pins 75 are provided on the vertical ribs 71*a* of the grid rib 71, but the pressing pins 75 may be provided on the horizontal ribs 71*b*. As shown in FIG. 7, the pressing pins 75 may be provided at intersections of the vertical ribs 71*a* and the horizontal ribs 71*b* of the grid rib 71. If the pressing pins 75 are provided at the intersections of the vertical ribs 71*a* and the horizontal ribs 71*b* in this way, rigidity of the pressing pins 75 can be further increased. Accordingly, pressing force of the electrical connection portion 41 of the terminal fitting 40 to the end surface 25*a* of the protruding portion 25 provided in the housing 20 can be increased, and the protruding length of the electrical connection portion 41 can be further accurately controlled.

According to the exemplary embodiments described above, a connector (10) configured to be joined to a mating connector, the connector (10) including: a terminal fitting (40) including an electrical connection portion (41) configured to be connected to a mating terminal of the mating connector; a housing (20) including an insertion hole (26) extending in a direction in which the electrical connection portion (41) is connected to the mating terminal, the electrical connection portion (41) being inserted through the insertion hole (26) from a rear side of the housing (20) and protruding from a front side of the housing (20); and a rear holder (60) attached to the rear side of the housing (20) such that the rear holder (60) presses and holds the terminal fitting (40) against the housing (20). The housing further includes a reference surface (for example, the end surface 25*a*) arranged to restrict the electrical connection portion (41), with a portion (for example, the connection portion 42) of the terminal fitting (40) abutting the reference surface, from being further inserted into the insertion hole (26). The rear holder (60) includes a pressing pin (75) configured to press, when the rear holder (60) is attached to the housing (20), the terminal fitting (40) from a rear side of the terminal fitting (40) such that the pressing pin (75) is partially and plastically deformed and such that the terminal fitting (40) is pressed against the reference surface.

According to the connector having the above configuration, when the rear holder is attached to the housing, the pressing pin presses the terminal fitting from the rear side and is partially and plastically deformed. Accordingly, the terminal fitting is pressed against the reference surface of the housing and is held such that the terminal fitting does not play in the connecting direction with the mating terminal, and the protruding length, in other words a protruding dimension of the electrical connection portion from a front end of the insertion hole, can be accurately controlled. Compared to a structure in which the electrical connection portion of the terminal fitting is inserted in a pressed-manner and fixed to the housing, play can be provided in upper-lower and left-right directions orthogonal to the connecting direction with the mating terminal. Accordingly, positional deviation with the mating terminal during joining with the mating connector can be absorbed, and the joining with the mating connector can be smoothly performed.

The connector (10) may further include the pressing pin (75) including a crushable distal end portion (76) configured to press the terminal fitting (40), the crushable distal end portion being tapered such that a cross-sectional area of the crushable distal end portion gradually decreases in a direction in which the crushable distal end portion presses the terminal fitting (40).

According to the connector having the above configuration, the pressing pin presses the terminal fitting, and the tapered distal end portion is crushed and plastically deformed. As a result, the terminal fitting can be held such that the terminal fitting does not rattle in the connecting direction with the mating terminal.

The connector (10) may further include the electrical connection portion (41) having a shape of a flat plate extending in the direction in which the electrical connection portion (41) is connected to the mating terminal. The pressing pin (75) may abut and presses a rear end surface (46) of the electrical connection portion.

According to the connector having the above configuration, since the rear end surface of the flat plate shaped electrical connection portion is pressed by the pressing pin, the electrical connection portion is pressed straight toward the connecting direction with the mating terminal of the mating connector, and the electrical connection portion can protrude from a front end of the insertion hole without inclination.

The connector (10) may further include the rear holder (60) further including a bottom surface (70) orthogonal to a direction in which the rear holder (60) is attached to the housing (20), and a grid rib (71) including a plurality of linear ribs (for example, the vertical ribs 71*a* and the horizontal ribs 71*b*) provided in a grid pattern on the bottom surface (70). The pressing pin (75) may be provided on the grid rib (71).

According to the connector having the above configuration, since the pressing pin is provided on the grid rib provided on the bottom surface, rigidity of the pressing pin can be increased, and the terminal fitting can be pressed more firmly against the reference surface, thereby controlling the protruding length of the electrical connection portion accurately.

The connector (10) may further include the pressing pin (75) provided at an intersection of the linear ribs (for example, the vertical ribs 71*a* and the horizontal ribs 71 *b*) of the grid rib (71).

According to the connector having the above configuration, since the pressing pin is provided at the intersection of the linear ribs, the rigidity of the pressing pin can be further increased, and the terminal fitting can be pressed more firmly pressed against the reference surface, thereby controlling the protruding length of the electrical connection portion further accurately.

What is claimed is:

1. An electrical connector configured to be joined to a mating connector, the connector comprising:

a terminal fitting comprising an electrical connection portion configured to be connected to a mating terminal of the mating connector;

a housing comprising an insertion hole extending in a direction in which the electrical connection portion is connected to the mating terminal, the electrical connection portion being inserted through the insertion hole from a rear side of the housing and protruding from a front side of the housing; and a rear holder attached to the rear side of the housing such that the rear holder presses and holds the terminal fitting against the housing, wherein the housing further comprises a reference surface arranged to restrict the electrical connection portion, with a portion of the terminal fitting abutting the reference surface, from being further inserted into the insertion hole, and wherein the rear holder comprises a pressing pin configured to press, when the rear holder is attached to the housing, the terminal fitting from a rear side of the terminal fitting such that the pressing pin is partially and plastically deformed and such that the terminal fitting is pressed against the reference surface.

2. The electrical connector according to claim 1, wherein the pressing pin comprises a crushable distal end portion configured to press the terminal fitting, the crushable distal end portion being tapered such that a cross-sectional area of the crushable distal end portion gradually decreases in a direction in which the crushable distal end portion presses the terminal fitting.

3. The electrical connector according to claim 1, wherein the electrical connection portion has a shape of a flat plate extending in the direction in which the electrical connection portion is connected to the mating terminal, and wherein the pressing pin abuts and presses a rear end surface of the electrical connection portion.

4. The electrical connector according to claim 1, wherein the rear holder further comprises a bottom surface orthogonal to a direction in which the rear holder is attached to the housing, and a grid rib including a plurality of linear ribs provided in a grid pattern on the bottom surface, and wherein the pressing pin is provided on the grid rib.

5. The electrical connector according to claim 4, wherein the pressing pin is provided at an intersection of the linear ribs of the grid rib.

6. The electrical connector according to claim 2, wherein the crushable distal end portion has a flat distal end orthogonal to a direction in which the rear holder is attached to the housing.

* * * * *